US006877607B2

(12) United States Patent
Jenkins

(10) Patent No.: US 6,877,607 B2
(45) Date of Patent: Apr. 12, 2005

(54) CAN END

(75) Inventor: Leonard Anthony Jenkins, Orland Park, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 58 days.

(21) Appl. No.: 10/258,237

(22) PCT Filed: Apr. 19, 2001

(86) PCT No.: PCT/GB01/01760

§ 371 (c)(1),
(2), (4) Date: Oct. 21, 2002

(87) PCT Pub. No.: WO01/83308

PCT Pub. Date: Nov. 8, 2001

(65) Prior Publication Data

US 2003/0126731 A1 Jul. 10, 2003

(51) Int. Cl.[7] ..... B65D 85/00

(52) U.S. Cl. ..... 206/459.1; 206/459.5; 220/600

(58) Field of Search ..... 220/600; 206/459.1, 206/459.5

(56) References Cited

U.S. PATENT DOCUMENTS

| | | | | |
|---|---|---|---|---|
| 3,843,014 A | | 10/1974 | Cospen et al. | 220/66 |
| 4,693,801 A | | 9/1987 | Bolte | 204/180.2 |
| 5,193,456 A | | 3/1993 | Wolfe et al. | 101/40 |
| 5,492,077 A | | 2/1996 | Rose | 116/307 |
| 5,566,850 A | * | 10/1996 | Forsyth et al. | 220/253 |
| 5,918,618 A | * | 7/1999 | Neupert | 137/14 |
| 6,053,349 A | | 4/2000 | Griggs, Jr. et al. | 220/269 |
| 6,065,634 A | | 5/2000 | Brifcani et al. | 220/619 |
| 6,105,806 A | | 8/2000 | Stasiuk | 220/269 |
| 6,234,336 B1 | * | 5/2001 | Neiner | 220/269 |
| 6,460,723 B1 | * | 10/2002 | Nguyen et al. | 220/619 |

FOREIGN PATENT DOCUMENTS

| | | |
|---|---|---|
| GB | 2 309 215 | 7/1997 |
| JP | 57/117323 | 7/1982 |
| JP | 08/072883 | 3/1996 |
| JP | 11/124142 | 5/1999 |
| WO | WO 96/37414 | 11/1996 |
| WO | WO 98/46383 | 10/1998 |
| WO | WO 99/09853 | 3/1999 |
| WO | WO 99/58407 | 11/1999 |

* cited by examiner

*Primary Examiner*—Joseph Man-Fu Moy
(74) *Attorney, Agent, or Firm*—Woodcock Washburn LLP

(57) ABSTRACT

A can end (1) having a chuck wall (3) which is inclined at an angle of between 30° and 60°. The chuck wall (3) is provided with an image (9) such as a logo, pattern, printed or etched image, typically for promotional purposes.

12 Claims, 2 Drawing Sheets

CAN END

CROSS-REFERENCSEES TO RELATED APPLICATIONS

This application claims foreign priority under 371 of Application Number PCT/GB01/01760 filed Apr. 19, 2001, which claims priority to Great Britain Application Number GB 0010256.6 filed Apr. 28, 2000.

This invention relates to a can end, and in particular to a can end containing promotional or informational material. Can ends are known which have been coated with a coloured coating, or where the centre panel of the can end has been printed with promotional material. WO99/09853 describes a can end with a decorated tab. However, the present invention provides an alternative to all of the above arrangements.

Accordingly there is provided a can end comprising a peripheral seaming flange, a chuck wall dependent from the interior of the seaming flange, an outwardly concave annular reinforcing bead extending radially inwards from the chuck wall, and a central panel supported by an inner portion of the reinforcing bead, the chuck wall being inclined to an axis perpendicular to the central panel at an angle of between 30° and 60°, characterised in that the chuck wall is provided with an image.

The image provided on the chuck wall is typically wording, one or more logos, a pattern, or a combination of some or all of these. The image is preferably a printed image, conceivably by the transfer of a sublimable ink from a carrier etc. Alternatively the image is an etched image. Other arrangements, such as embossing, scoring etc. may conceivably also be employed.

This type of can end is in accordance with our earlier patent application WO96/37414. A can end of this type, having a chuck wall angle of between 30° and 60°, provides a greater impact for informational or promotional material.

The invention further resides in a method of manufacturing a can end comprising the steps of:

i) providing a coil of metal;

ii) stamping the coil into a plurality of blanks;

iii) forming each blank into an end shell comprising a radially outer seaming flange, a chuck wall adjacent the seaming flange, a centre panel and an axially downward countersink joining the centre panel to the chuck wall, the chuck wall being inclined to an axis perpendicular to the central panel at an angle of between 30° and 60°;

iv) converting the shell to an easy open can end by the steps of:

a) forming a score on a portion of the centre panel; and b) forming a tab and attaching the tab to the centre panel, characterised by the step of providing an image on the chuck wall of the can end.

The image may be provided on the chuck wall in various ways. In accordance with one aspect of the invention, an area of the coil is provided with an image such that, when each blank is formed into a can end, the image is present on the chuck wall of the can end. In this arrangement care must be taken to maintain the registration of the coil and blank throughout the end making process. According to an alternative aspect of the invention an area of the blank is provided with an image such that, when the blank is formed into a can end, the image is present on the chuck wall of the can end. Alternatively the image is added to the chuck wall when the end shell has been formed and before it is converted into a can end. Conceivably the image may even be added to the chuck wall after the end shell has been converted into a can end. The choice of when to apply the image may depend on the choice of method of applying the image. For example, where the chuck wall is to be printed, the type of ink to be employed (e.g. whether it be a thermally cured or even a UV cured ink), may govern the suitability of when to apply the image. Furthermore, the method of application of the ink, such as by a printing blanket or tampon or by means of ink jet printing, may also affect the choice of manufacturing technique.

The invention will now be further described, by way of example only, with reference to the accompanying drawings, in which FIG. 1 is a perspective view of a can end in accordance with the present invention;

Figure 1:
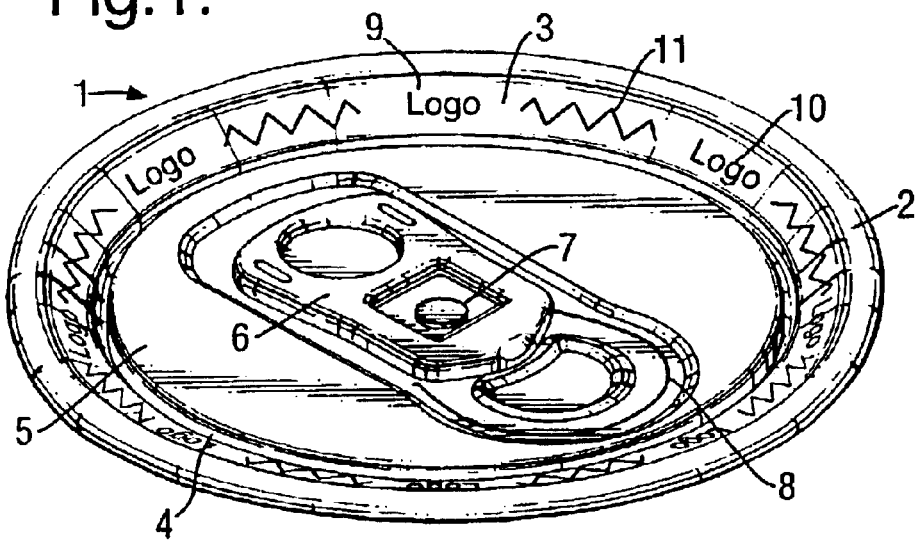

Referring to the Figures, the can end shown generally at 1 includes a seaming flange 2 (also known as a cover hook) and a chuck wall 3 extending axially and inwardly from the interior of the seaming flange 2. An outwardly concave reinforcing bead 4 (also known as a countersink) extends radially inwards from the chuck wall 3, and a central panel 5 is supported from the inner portion of the reinforcing bead 4. The centre panel includes a tab 6, secured to the centre panel by means of a rivet 7, and pivotable to break a score 8 in order to open an aperture in the can end. The chuck wall 3 extends at an angle of approx. 43° to the perpendicular (vertical), and is printed with an image 9, comprising logos 10 and a pattern 11. The image 9 is printed using a UV curable ink.

Figure 2:
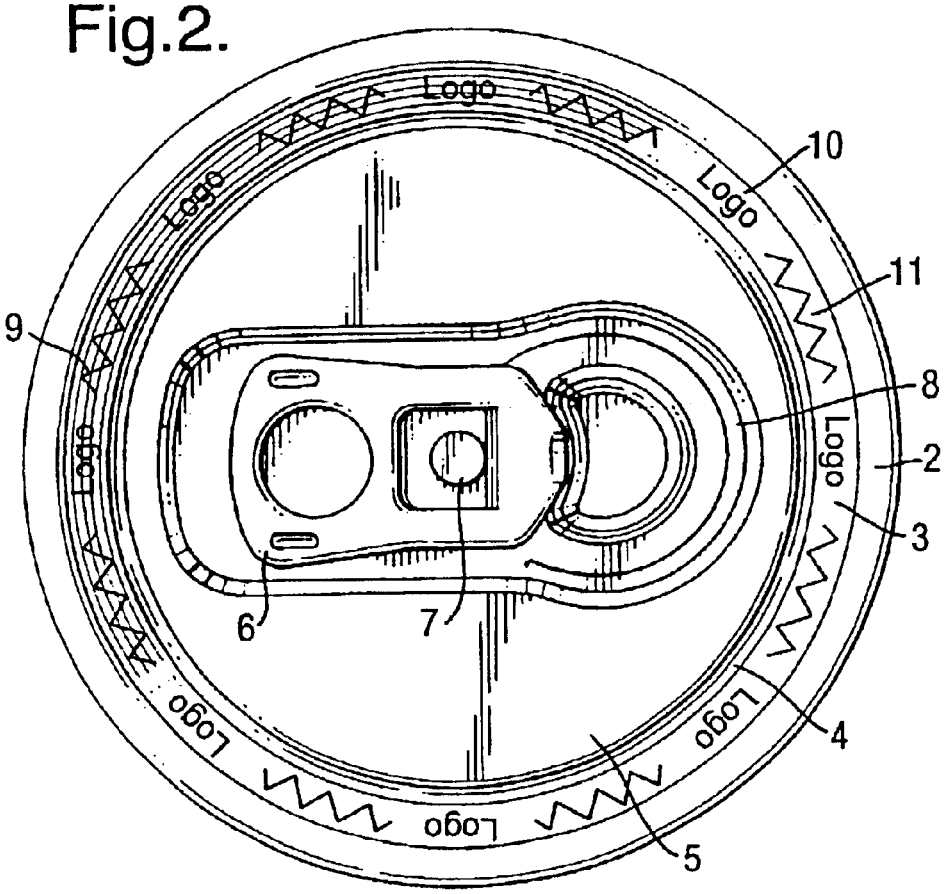
FIG. 2 is a plan view of the can end of FIG. 1.
Figure 3:
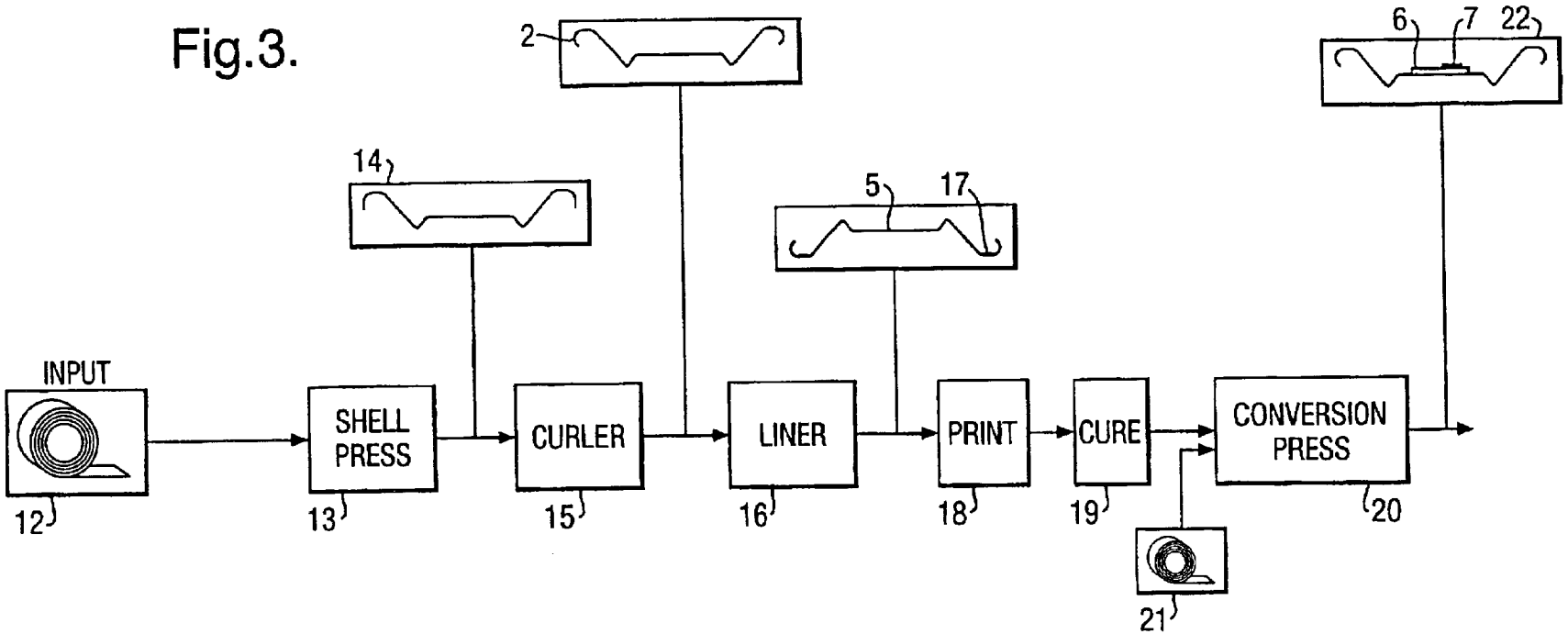
FIG. 3 is a schematic process diagram for the manufacture of can ends in accordance with the present invention.

FIG. 3 shows the manufacturing process used to produce the ends of FIGS. 1 and 2. A coil 12 of pre-lacquered and lubricated aluminium alloy is fed to a shell press 13 which stamps out blanks and forms them into a shell shown generally at 14. The end shell 14 is then fed on a carrier belt to a curler 15 which curls over the edges of the shell to form the seaming flange 2. The curled shells are then fed to a liner 16 where they are inverted, spun and compound is injected onto the underside of the seaming flange as shown at 17.

The lined end shells are then fed on the carrier belt to a print station 18 where the chuck wall 3 is printed with an image using a UV curable ink. The ink is then cured by a burst of UV radiation at a curing station 19. The printed end shells are then fed on the carrier belt to a conversion press shown generally at 20. The rivet 7 is raised on the centre panel 5 of the shell, and the score 8 is applied to the centre panel to define the portion operable to produce an opening therein. More aluminium end stock 21 is used to produce a tab 6 which is staked to the end shell via the rivet on the centre panel. The resulting can end is shown generally at 22.

As an alternative to the process of FIG. 3, the coil 12 may be pre-printed with the image 9, such that when the end shell 14 is converted into a can end, the image 9 appears on the chuck wall 3. Other alternatives include the placing of the print station 18 and curing station 19 elsewhere in the line, such as between the shell press 13 and the curler 15, or even at the end of the line following the conversion press 20.

What is claimed is:

1. A can end comprising a peripheral seaming flange, a chuck wall dependent from the interior of the seaming flange, an outwardly concave annular reinforcing bead extending radially inwards from the chuck wall, and a central panel supported by an inner portion of the reinforcing bead, the chuck wall being inclined to an axis perpendicular to the central panel at an angle of between 30° and 60°, wherein the chuck wall is provided with an image.

2. A can end according to claim 1, wherein that the image consists of wording.

3. A can end according to claim 1, wherein that the image consists of one or more logos.

4. A can end according to claim 1, wherein that the image consists of a pattern.

5. A can end according to claim 1, wherein the image is printed image.

6. A can end according to claim 1, wherein the image is an etched image.

7. A can end according to claim 2, wherein the image is printed image.

8. A can end according to claim 2, wherein the image is etched image.

9. A can end according to claim 3, wherein the image is printed image.

10. A can end according to claim 3, wherein the image is etched image.

11. A can end according to claim 4, wherein the image is printed image.

12. A can end according to claim 4, wherein the image is an etched image.

* * * * *